US005348485A

United States Patent [19]

Briechle et al.

[11] Patent Number: 5,348,485

[45] Date of Patent: Sep. 20, 1994

[54] ELECTRONIC PRICE DISPLAY SYSTEM WITH VERTICAL RAIL

[75] Inventors: George T. Briechle, New Canaan; David H. Lubowe, Westport; Alfred D. Dobras, Trumbull, all of Conn.

[73] Assignee: Electronic Retailing Systems Int'l Inc., Wilton, Conn.

[21] Appl. No.: 45,910

[22] Filed: Apr. 12, 1993

[51] Int. Cl.[5] ..... H01R 25/14

[52] U.S. Cl. ..... 439/110; 439/121; 364/403

[58] Field of Search ..... 439/111, 113, 119, 120, 439/121, 214; 174/68.3; 364/403

[56] References Cited

U.S. PATENT DOCUMENTS

| | | |
|---|---|---|
| 2,108,031 | 2/1938 | Acuff . |
| 2,822,631 | 2/1958 | Lynch . |
| 3,044,035 | 7/1962 | Adams, Jr. . |
| 3,718,816 | 2/1973 | Seelbach et al. . |
| 3,894,170 | 7/1975 | Schinzel . |
| 4,002,886 | 1/1977 | Sundelin . |
| 4,029,378 | 6/1977 | Bolis . |
| 4,082,393 | 4/1978 | Gamble . |
| 4,108,523 | 8/1978 | Bolis . |
| 4,346,453 | 8/1982 | Drapeau et al. . |
| 4,500,880 | 2/1985 | Gomersall et al. . |
| 4,766,295 | 8/1988 | Davis et al. . |
| 4,783,740 | 11/1988 | Ishizawa et al. . |
| 4,812,134 | 3/1989 | Miller et al. . |
| 4,821,291 | 4/1989 | Stevens et al. . |
| 4,888,709 | 12/1989 | Revesz et al. . |
| 4,907,137 | 3/1990 | Schladitz et al. . |
| 4,939,861 | 7/1990 | Soubliére . |
| 4,962,466 | 10/1990 | Revesz et al. . |
| 5,008,493 | 4/1991 | Wagener . |
| 5,019,811 | 5/1991 | Olsson et al. . |
| 5,111,196 | 5/1992 | Hunt . |
| 5,172,314 | 12/1992 | Poland et al. . |
| 5,198,644 | 3/1993 | Pfieffer et al. . |
| 5,241,467 | 8/1993 | Failing et al. . |
| 5,245,534 | 9/1993 | Waterhouse et al. . |

FOREIGN PATENT DOCUMENTS

| | | | |
|---|---|---|---|
| 0396414 | of 0000 | European Pat. Off. . | |
| 299355 | 1/1989 | European Pat. Off. . | |
| 0428055 | 5/1991 | European Pat. Off. | 439/111 |
| 9305456 | 3/1993 | PCT Int'l Appl. . | |
| 9305475 | 3/1993 | PCT Int'l Appl. . | |
| 2197564 | of 0000 | United Kingdom . | |
| 2228812 | of 0000 | United Kingdom . | |

*Primary Examiner*—Eugene F. Desmond
*Attorney, Agent, or Firm*—Oppedahl & Larson

[57] ABSTRACT

A vertical stringer or rail system is provided for use with an electronic price display system in a store, warehouse or other application. A vertical rail is made of an insulating material and is of substantially constant cross section along its extent, with ridges along each edge. A channel in the front face of the rail carries a plurality of exposed conductors, and the channel and edges are keyed. Snap-on connectors fit to the rail, and due to the keying it is impossible to snap the connector on backwards. The snap-on connectors each have a flat cable running to a shelf rail at the front of a shelf, and electronic price display labels lie within the shelf rail. U-shaped snap-on cable clamps provide clamping of the flat cable to the vertical rail nearby to the snap-on connectors, and the cable clamps are captive to the flat cable so they are not easily misplaced. Because the snap-on connectors and clamps may be snapped on at a multitude of locations they can easily accommodate shelves at varying heights. Shelf moves are easily accommodated regardless of starting and ending shelf positions.

27 Claims, 4 Drawing Sheets

ELECTRONIC PRICE DISPLAY SYSTEM WITH VERTICAL RAIL

BACKGROUND OF THE INVENTION

Much attention has been given in recent years to the problem that when an item of merchandise is selected in a store, the price charged at checkout may differ from the price a customer expected to pay. This problem presents itself most prominently when a laser scanner is used at checkout, reading a uniform product code bar code and ringing up a price based on the contents of a database; if the contents of the database were to fail in some respect to match prices previously communicated to the customer (whether by product markings or by nearby shelf markings), then sooner or later a customer will be charged a price different from that which was expected.

One approach to this problem is to provide, within the store, a set of electronic price displays, one for each item of merchandise in the store. The information shown on the displays is desirably based on the same database that informs the checkout scanners, and barring equipment malfunction the price displayed at the shelf will be consistently identical to that charged at checkout.

The uninitiated might consider it to be a straightforward engineering matter to provide such a system of electronic price displays. Experience has uncovered many problems which do not yield to the first approach that might suggest itself. The solutions which one might try almost uniformly turn out to be prodigiously expensive to implement and discouragingly unreliable.

One family of difficulties relates to the selection of a communications architecture and topology by which a central computer or host may exchange messages with the multitude of electronic price displays (typically several tens of thousands) in a retail store. A number of engineering factors lead to a preferred topology that is tied to the physical layout of the store. A store generally has gondolas with shelves on each side, and the result as perceived by the customer is a number of aisles between the gondolas. In the preferred topology a central computer communicates with gondola controllers, one on each gondola. From a gondola controller a horizontal cable runs along the length of the gondola (typically along the top thereof). The gondola is made up of sections typically four feet long, and each section holds shelves that are typically four feet long. At each four-foot section, or at least at every other four-foot section, a vertical cable is installed. Each vertical cable is connected with the horizontal cable. On the front of each shelf a shelf rail is installed, and it is necessary to make some sort of connection with the vertical cable.

Many different cabling configurations have been attempted, as have many different connector technologies. None have heretofore been successful, however. In one technology, for example, at installation time the connections between shelf rails and the vertical rails have been accomplished by crimp-type connectors. This and most other technologies used heretofore have the drawback that if a shelf is to be moved subsequently (a not infrequent event in stores) it becomes necessary to make a connection at a different place on the vertical rail, requiring additional crimping activity at an awkward time and place.

It is also important to realize that while it may happen from time to time that one installs an electronic price display system in a store that is under construction, by far the more frequent business need is to install such a system in a store that is already in operation. Thus to be successful a technology must be workable despite a store's being in operation under circumstances where it is not easy to install any additional wiring, let alone wiring in the places that would be most convenient to the installer.

It is also important to realize that stores and gondolas differ greatly from one to the next in dimensions and design. As a result, it is desired to have a technology that is readily adaptable to the differing store and gondola circumstances.

Prior art technologies have the additional drawback that they are expensive to install. It will be appreciated that the number of electronic price displays in such a system is typically several tens of thousands, corresponding to the number of distinct store stock items. The number of shelf rails is perhaps one-fourth as many as the number of displays, but still in the thousands. Each shelf rail must be connected in some way with the central computer, so that the number of distinct connections to be made at installation time is linearly related thereto. Each connection must be easy, even for those with minimal training, must accommodate a variety of physical store shelf hardwares, and must be of inexpensive rather than exotic parts. Any cost-related or reliability-related misstep in design or materials selection is magnified thousandfold in the topology tied to shelf rails.

It is desirable to have a technology for store wiring that is easy to install by technicians of limited training, that accommodates store shelves that may or may not be empty or fully accessible, that is inexpensive to fabricate in the first place, and that uses commonly available materials and components to the extent possible. It is desirable to have a technology in which linearly disposed non-cable elements may be cut to length on site to fit actual store needs, and in which cabled elements do not require on-site labor-intensive cutting, shortening, or terminating steps, but which instead may be supplied with predetermined cable lengths and with design elements that dress and protect the cables, including any excess lengths. It is desired that the technology be robust against the hazards to which it is exposed, including the possibility of shorts due to errant surrounding materials. Finally, it is desirable to design in elements that minimize the possibility of inadvertent incorrect connections.

SUMMARY OF THE INVENTION

A vertical stringer or rail system is provided for use with an electronic price display system in a store, warehouse or other application. A vertical rail is made of an insulating material and is of substantially constant cross section along its extent, with ridges along each edge. A channel in the front face of the rail carries a plurality of exposed conductors, and the channel and edges are keyed. Snap-on connectors fit to the rail, and due to the keying it is quite difficult if not impossible to snap the connector on backwards. The snap-on connectors each have a flat cable running to a shelf rail at the front of a shelf, and electronic display units lie within the shelf rail. The flat cable exits from the connector directionally, which promotes proper connector orientation. U-shaped snap-on cable clamps provide clamping of the flat cable to the vertical rail nearby to the snap-on connectors, and the cable clamps are captive to the flat cable so they are not easily misplaced. Because the snap-on connectors and clamps may be snapped on at a multitude of locations they can easily accommodate shelves at varying heights. Another fastener clamps onto the vertical bus and adheres to the gondola. Shelf moves are easily accommodated regardless of starting and ending shelf positions.

DESCRIPTION OF THE DRAWING

The invention will be described with respect to a drawing, of which.

Where possible like elements in the various figures are shown with like reference numerals.

DETAILED DESCRIPTION

Figure 1:
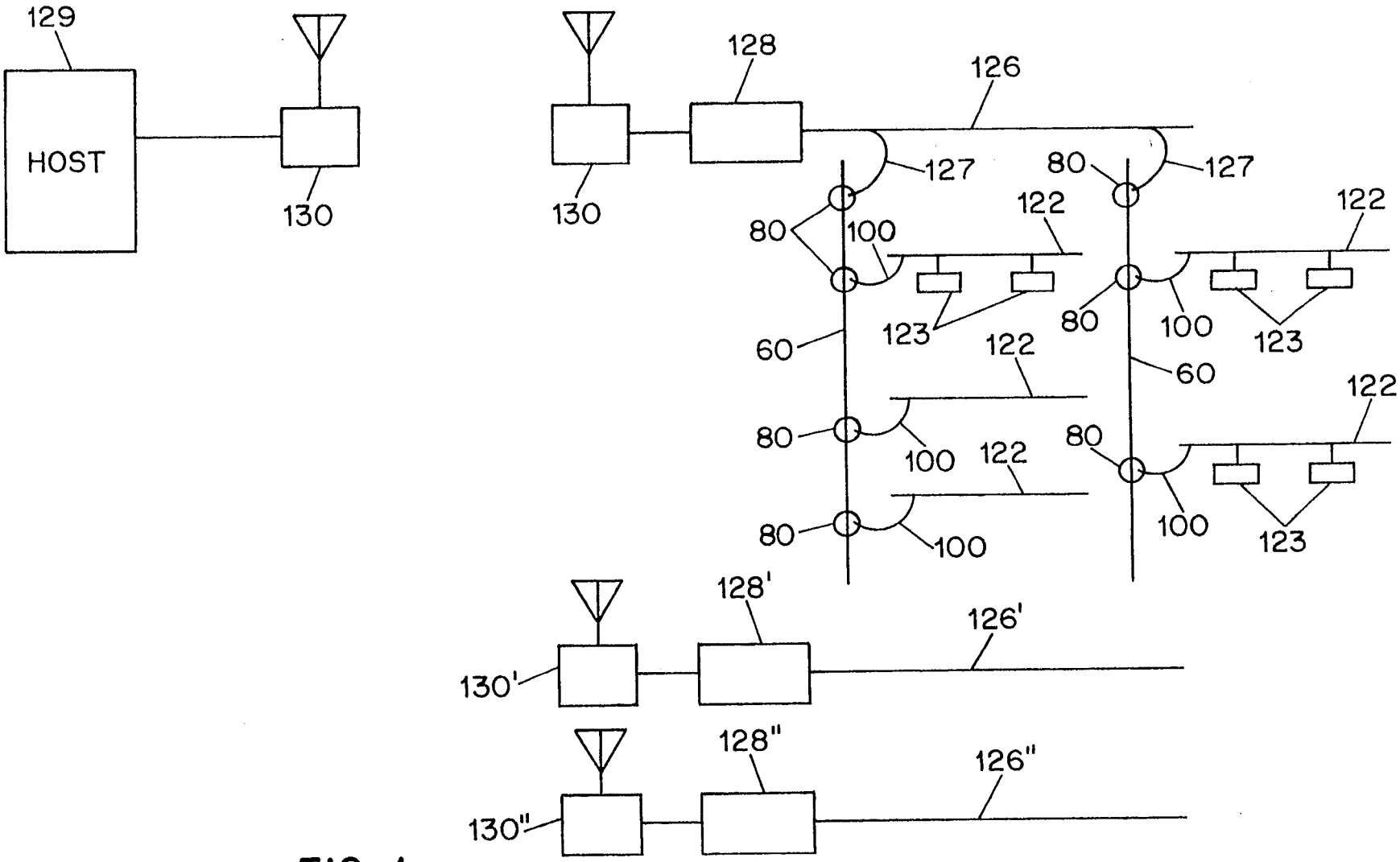
FIG. 1 shows in schematic form a topology for communication links in an electronic price display system.

In FIG. 1 a typical topology is shown for communication links in an electronic price display system. The central computer or host 129 is shown, of which there is typically one per store. Gondola controllers 128 are disposed at each gondola in the store. The host and gondola controllers may be hard-wired to each other, or may instead be in communication by means of low-power spread-spectrum local area network radio frequency modems, or narrow-band RF or other wireless means such as infrared. If RF modems are used, they may be conventional RF modems operating in UHF spectrum set aside for such purposes, in which case the modems 130 are physically identical, differing only in the network addresses for which they are programmed.

Each gondola controller has line drivers and line receivers providing signals for horizontal bus 126 (and 126' and 126'') each of which is preferably run along the tops of the gondolas. Each horizontal bus preferably carries a three-wire serial bus, with one wire for power, a second for ground, and a third wire for bidirectional data. This bus, as described below, is propagated to corresponding three-wire buses on the shelf rails and from there to electronic display units such as price labels. A typical bus design for this use is described in copending U.S. application Ser. No. 7/995,048, assigned to the same assignee as the present application. A technique for confining the consequences of a power line short in a shelf rail is given in copending U.S. application Ser. No. 7/757,259, assigned to the same assignee as the present application. A technique for confining the consequences of a data line short in a shelf rail is given in copending U.S. application Ser. No. 8/008,200, assigned to the same assignee as the present application. Serial communications protocols for exchanges of messages between labels and the host are described in copending U.S. application Ser. No. 7/995,048, assigned to the same assignee as the present application. A desirable physical design for the labels and shelf rails is described in copending U.S. application Ser. No. 7/965,877, assigned to the same assignee as the present application. A system integrating a store price display system with a printer for paper labels is disclosed in U.S. Pat. No. 5,172,314, assigned to the same assignee as the present application.

Returning to FIG. 1, in the system according to the invention the shelf rails 122 are not wired directly to the horizontal bus 126 but are instead wired by jumpers (preferably flat cables) 100 to vertical rails 60. The conductors of the shelf rail 122 correspond in number to the wires of the flat cable 100 of a corresponding snap-on connector 80 and are electrically connected therewith.

The vertical rails are wired by a connector 80 and jumper 127 to the horizontal bus. It will be appreciated that the connector 80 serves double duty—once at the top of each vertical rail to supply signals to it, and again at shelf locations along the vertical rail to provide the signals to the shelf rails. In this way, each electronic price display label 123 is able to exchange messages with the host 129. There is typically at least one display label on each shelf rail 122.

Figure 2:
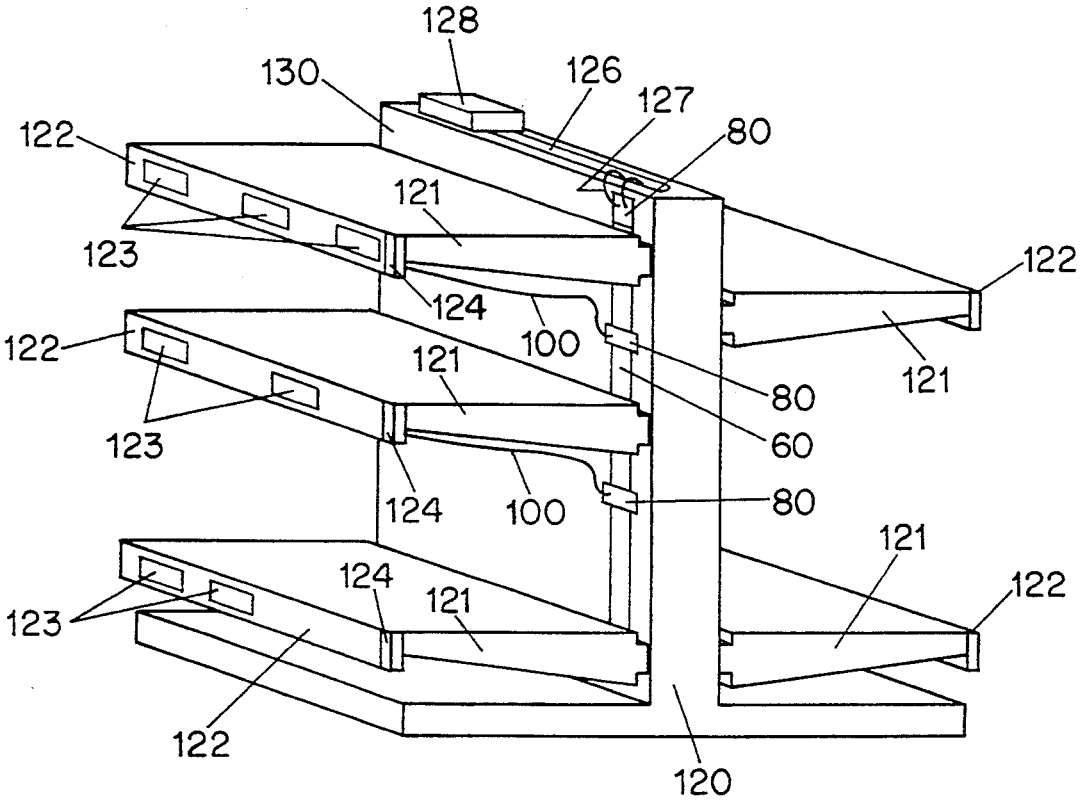
FIG. 2 is a perspective view of a four-foot gondola section.

Turning now to FIG. 2, there is shown a perspective view of an exemplary four-foot gondola section 120. The section has shelves 121 and behind the shelves 121 is a flat wall or planar surface 130. The gondola design is such as to permit a particular shelf 121 to be installed at any of numerous vertical positions, and to permit installing, removing, raising, and lowering of shelves arbitrarily often thereafter.

The items described thus far in FIG. 2 are found in prior art retail stores. To provide an electronic price display system according to the invention, however, a gondola controller 128 is mounted on the gondola, along with a horizontal bus 126. Shelf rails 122 are mounted to the front edges of the shelves 121, and each shelf rail 122 can accommodate a number of electronic price displays 123. Behind the shelves 121 is a vertical rail 60. The lengthwise spacing of vertical rails 60 along the gondola 120 may be every shelf length (here, four feet) or perhaps every other shelf length (here, every eight feet). Each vertical rail 60 is electrically connected with the horizontal bus 126 by a jumper 127.

What remains to complete the system as shown in FIG. 2 are end caps 124 on the shelf rails 122. Each end cap provides a connection with a cable 100, preferably a flat cable. The flat cables 100 are each terminated (preferably prior to the store installation activity) with a connector 80 which snaps onto the vertical rail 80. As will be described further below, the design of the snap-on connector is such that it serves not only for the connector 80 of the cable 100 but also as the connector between the jumper 127 and the vertical rail 60. The flat cables 100 are preferably made with an adhesive on one side, which is protected with a removable strip. The horizontal bus 126 is preferably a cable. Also as described below, however, the horizontal bus 126 may optionally be selected from the same rail stock as the vertical rails 60, in which case the same snap-on connector 80 may be used between the jumper 127 and the rail 126, and at the gondola controller 128. Use of a single piece part for the snap-on connectors at those locations offers economies. Use of the same rail stock for the rails 60 and 126 also offers economies.

As will be described below in more detail, the rail stock for the vertical rails 60 (and, if desired, for the horizontal buses 126) is of constant cross section and is supplied in long lengths capable of being cut to fit on site during installation. The cut-to-fit capability permits working with varying store designs and gondola designs. It also makes it easy, during an installation, to work around unexpected shapes and dimensions in a particular store.

The constant cross section of the rail stock offers yet another benefit described further below, namely that the connectors 80 may be snapped into place at quite arbitrary locations along the rail. This makes it easy to match any particular shelf location, and makes it easy to dress away any excess length of cable 100 so that it is out of harm's way. One way to describe the rail stock is that it comprises a mating connector for the connector 80.

The snap-on quality of the connectors 80 offers still another benefit described further below, namely that if a shelf is later to be removed or moved it is easy to unsnap the connector 80, and to replace it, if the shelf is replaced, at a position matching the new shelf position.

Figure 3:
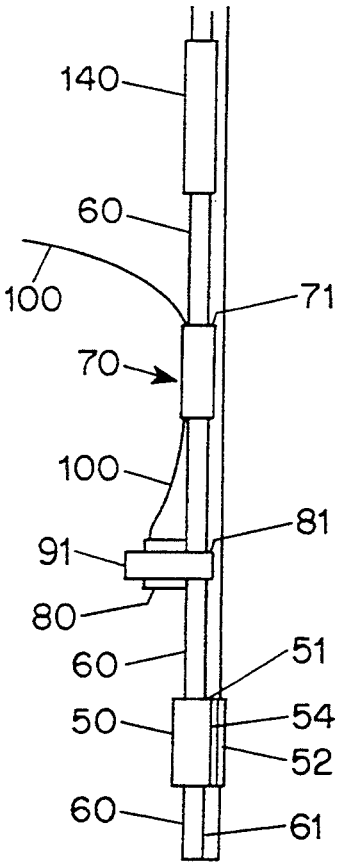
FIG. 3 is a side view of a vertical rail according to the invention.

Turning now to FIG. 3, there is shown a side view of a portion of a vertical rail 60 according to the invention. For clarity only a portion of the rail 60 is shown. The rail 60 is adjacent to a planar surface, not shown for clarity but disposed to the right in FIG. 3. The rail 60 has ridges 61, one of which is visible in FIG. 3. Fastener 50 may be seen, with tab 54 and adhesive portion 52. In actual installations more than one fastener 50 would preferably be employed, at least one of which would be in the top half of the rail and at least one of which would be in the bottom half of the rail. The adhesive is selected for ready attachment to the planar surface. It is understood of course that other implementations are possible. Alternatively, other means of attachment may be used, such as screws through the tabs, without deviating in any way from the invention.

Also shown in FIG. 3 is a snap-on cover 140, which is used to protect the exposed conductors of the rail from metal objects or spills. The cover, like the fastener, is preferably extruded from rigid PVC (polyvinyl chloride) and has substantially constant cross section. The fastener is preferably cut to one-inch lengths, while the cover may be longer as needed. Since the cutting is a post-extrusion process, other lengths may readily be chosen if desired.

Also shown in FIG. 3 is short piece of the material from which the cover 140 is made, which serves as a cable clamp 70. The cable clamp 70 not only protects the exposed conductors of the rail as does the cover, but also acts as a cable clamp for the flat cable 100. As will be described below in more detail, a ridged inner structure of the clamp 70 mates with the flat cable 100 so that the clamp is not lost when being removed or replaced.

Also shown in FIG. 3 is snap-on connector 80 which provides a secure mechanical and electrical connection between the cable 100 and the rail 60. The connector, shown in more detail below, is capable of being removed by squeezing tabs 91.

The cover 140, the clamp 70, the fastener 50, and the connector 80 all engage reliably with the rail 60 by its ridge 61. Corresponding regions 71, 81, and 51 engage with the ridge 61 as shown in more detail below.

Preferably the covers 140, the clamps 70, the fasteners 50, and the connectors 80 between them cover substantially all of the otherwise exposed conductors of the rail 60. Also preferably the positioning of the connectors 80 and clamps 70 is such as to dress neatly any excess in the length of flat cable 100 so that the flat cable is kept out of harm's way to the extent possible.

Figure 4:
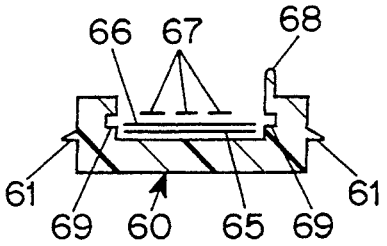
FIG. 4 is a cross-sectional view of the vertical rail in greater detail.

Turning now to FIG. 4, there is shown a cross-sectional view of the vertical rail 60 in greater detail. The main body of the rail is preferably extruded rigid PVC of constant cross section, although other materials could be used, preferably insulating materials. External ridges 61, symmetrically disposed, secure other elements to the rail 60. Keying ridge feature 68 is provided to prevent inadvertent snapping on of a connector backwards to the rail 60. Conductors 67 are tin-plated metal on a mylar backing 66 which has an adhesive backing 65 already in place. It is understood that other techniques could be used to connect the conductor array and the plastic body of the rail. The mylar-backed flat cable is installed to the PVC body by being fed from a reel and guided into place by use of a roller or other mechanical process yielding the same effect.

Those skilled in the art will appreciate that while tin-plated contacts are described herein, other contacts such as elemental copper or gold-plated contacts could also be used. Finally, it will be noted that even if the adhesive 65 were omitted, or if it were to weaken or fail in use, the connectors 80 engaged with the rail would tend to hold the mylar backing 66 and its conductors 67 in proper position.

Those skilled in the art will appreciate the extraordinary time and labor savings presented by the rail design of FIG. 4. Prior art experimental vertical cable technologies have all proven quite unworkable. Some are too floppy to be readily snaked down from above into the spaces between shelves 121 and back walls 130 for the simple reason that many types of cable can only be pulled and not pushed into place. Some work well only if the take-off points for connection of cables 100 are affixed to the vertical cable prior to its being snaked into place, in which case the take-off points themselves interfere with snaking the cable into place, often requiring that wedges be inserted between the rear of the shelves 121 and the back wall 130 in order to provide an adequate opening. Some require crimping activity from cables 100 onto the vertical cable after the vertical cable is in place.

In striking contrast, the vertical rail stock of the system according to the invention is rigid enough to be largely self-supporting when being snaked into place on a gondola. Its constant cross section, with the absence of any pre-installed take-off points, lets it slip readily into place. Store installations are much faster than with prior art vertical cabling approaches, with attendant cost savings. The vertical rail stock is capable of being radiused to as tightly as 1 foot, permitting the snaking path to accommodate a variety of obstructions and constraints. The result is a rail that has the flexibility of being installed in tight spaces. It will be appreciated that the rail may be characterized as a flexible, semirigid rail, capable of being easily snaked or pushed into place despite obstructions from shelves and the like, thus differing substantially from many cabling systems that have to be pulled into place. The flexible yet semirigid characteristics of the rail result from the materials used, and the form or cross section, i.e. section modulus of the extruded stock.

To summarize, what is shown is a vertical rail 60 of an insulating material, said rail being of substantially constant cross section along its extent, said rail having a front and a back, said rail having first and second edges along its extent and a ridge 61 along each edge, said rail having a channel in the front face and a plurality of exposed conductors 67 within the channel, the first and second edges further comprising first keying means rendering the first and second edges nonsymmetrical with respect to reflection in the plane lying therebetween.

Figure 5:
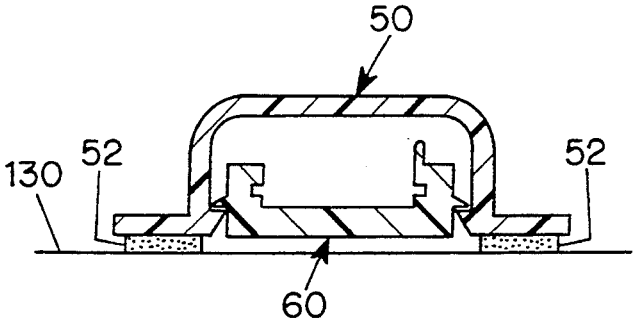
FIG. 5 is a cross sectional view of a rail and a rail fastener against a planar surface.

Turning now to FIG. 5, there is shown a cross sectional view of a rail 60 and a cable fastener 50 against a planar surface 130. Adhesive backing 52 may be seen which secure the fastener 50 to the surface, and thus necessarily secure the rail 60 to the surface. The back of the rail 60 contacts the surface 130, and the front of the rail is away from the surface. In general it is assumed that nothing will lie between the fastener 50 and the channel of the rail 60 other than conductors 67 (omitted here for clarity) except, in some instances, a loop of cable 100 if folded and dressed into that space to confine any excess length of the cable 100.

Those skilled in the art will readily appreciate that the stock used for the vertical bus 60 could be used for the horizontal bus 126 as well, in which case the fasteners 50 may be used as with it as well. On the other hand, if the horizontal bus 126 is made of material (such as cable) other than that used for the vertical bus 60, then the fasteners 50 may nonetheless happen to be convenient for use as cable clamps for the horizontal bus 126.

Figure 6:
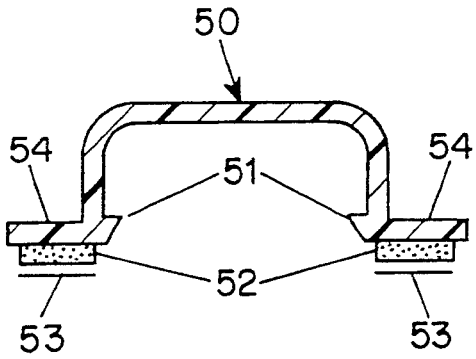
FIG. 6 shows the rail fastener of FIG. 5 in a more detailed cross section.

FIG. 6 shows the vertical rail fastener of FIG. 5 in a more detailed cross section. Internal ridges 51 engage with the external ridges 61 of the rail 60. Tabs 54 extend to the two sides, adhesive 52 (typically a double-sticky foam strip) is placed thereon, and a removable strip 53 is kept in place until the fastener is to be stuck to a wall 130. The fastener is preferably extruded rigid PVC, and the adhesive backings 52 are preferably substantially coplanar to engage adhesively with a flat surface such as the wall 130.

What has been shown is a fastener 50 of substantially constant cross section along its length and having a front and a back, the back of the fastener having a concavity shaped to accommodate the rail 60, the fastener 50 further comprising first and second tabs 54 disposed opposite each other with the concavity therebetween.

Figure 7:
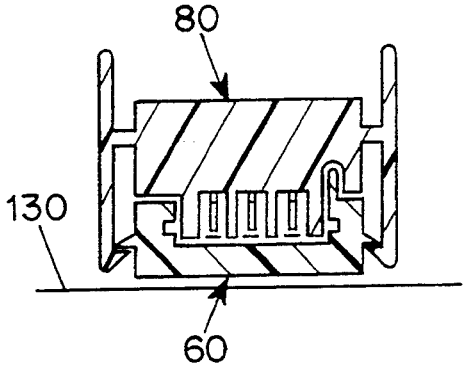
FIG. 7 is a cross section of the vertical rail together with a snap-on connector.

Turning now to FIG. 7, there is shown a cross section of the vertical rail 60 together with a snap-on connector 80. In such configuration wall 130 is typically at the rear of the rail 60, providing a positive support for the action of snapping the connector 80 onto the rail 60.

Figure 8:
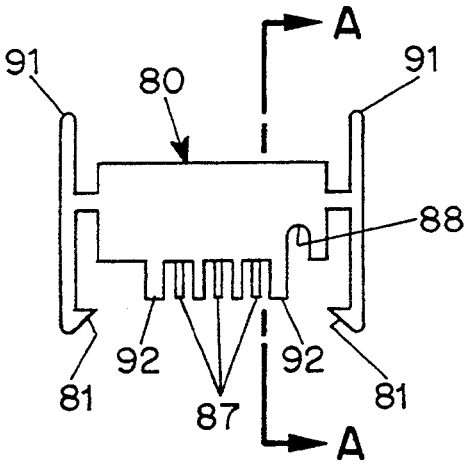
FIG. 8 is a front view of the snap-on connector of FIG. 7, defining section A.

FIG. 8 shows the snap-on connector of FIG. 7 in front view in more detail. Ridges 81 are shaped and positioned to engage with ridges 61 of the rail 60. Tabs 91 may be squeezed toward each other to release the connector 80 from the rail 60. Abutment features 92 define the spacing between the connector 80 and the conductors 67 (omitted from FIG. 8 for clarity). Recess 88 is shaped to match keying ridge 68. Springy metal contacts 87 are positioned to line up with the conductors 67. Barriers integrally formed in the connector lie between the contacts 87 to minimize shorts due to adjacency. Preferably all the features of the connector 80 visible in the view of FIG. 8 (except the metal contacts 87) are molded integrally of a single plastic, preferably high-density nylon.

Figure 9:
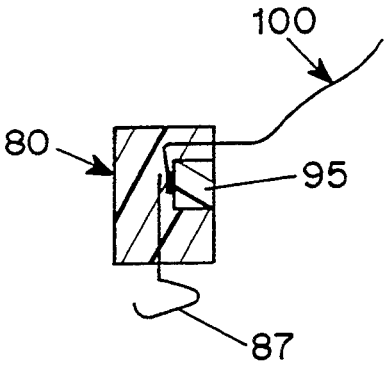
FIG. 9 is a sectional view of the snap-on connector of FIG. 8.

Sectional lines A in FIG. 8 define the sectional view shown in FIG. 9. Springy contact 87 is shown, which is inserted into the main body of the connector 80, and has barbs that are formed into its shaft; the barbs are compressed to slip past retention points which are molded into the plastic. Flat cable 100 will have been stripped and inserted into the body alongside the contacts 87. Then a plastic retainer 95 will have been pressed into a matching slot in the connector body. Preferably retainer 95 is molded along with the main body of the connector. The retainer 95 ensures both a reliable mechanical connection and a reliable electrical connection. Preferably retaining slots are provided so that the flat cable 100 may be folded to 90 degrees (exiting from the right in FIG. 9) and held there by the shape of the connector. As a result, the cable 100 is dressed to run parallel to the rail 60.

The dimensions, shape, spring constant and composition of the contacts 87 are selected so as to provide a reliable tensioned contact between the connector and the conductors 67. The contacts 87 are preferably made of phosphor bronze with tin plating or other reliable material, and may be made of the same materials as the springy contacts on the electronic price display labels 123 which make contact with the conductors of the shelf rails 122.

Summarizing, what is shown is a plurality of snap-on connectors 80 to be mated to each rail 60, each connector 80 having first and second members 81 engaged with the ridges 61 of the first and second edges of the rail 60, each connector 80 further comprising springy contacts 87 corresponding in number with the plurality of exposed conductors 67 of the rail 60 and disposed in tensioned mechanical contact therewith, each connector 80 having a flat cable 100 with wires corresponding in number with the springy contacts 87 and electrically bonded therewith, each connector 80 shaped between its first and second members so as to define a keying means 88 mating with the first keying means 68.

Figure 10:
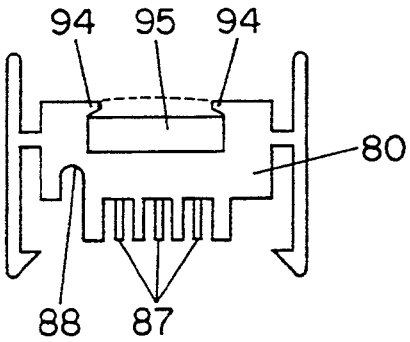
FIG. 10 is a rear view of the snap-on connector of FIG. 8.

FIG. 10 is a rear view of the snap-on connector of FIG. 8. Recess 88 is again visible (to the left in FIG. 8, rather than to the right as in FIG. 8) as are contacts 87. Retainer 95 is seen after it has been pressed into place. Ridges 94 are selected to be closer together than the width of cable 100. During initial assembly the cable 100 (not shown for clarity in FIG. 10) may enter the connector 80 from above, and if so, then after the retainer 95 has been pressed into place the cable 100 will be folded to 90 degrees (as mentioned above) and brought out (out of the page in the view of FIG. 10) between the ridges 94 and the retainer or insert 95.

Figure 11:
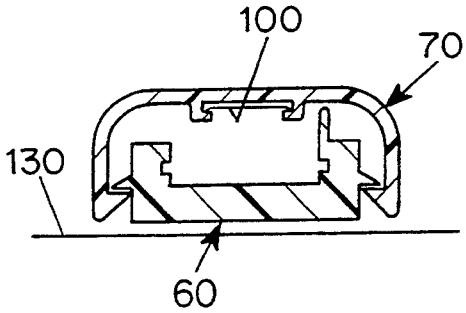
FIG. 11 is a cross-section view of the vertical rail together with a cable and a cable clamp attached thereto.

FIG. 11 is a cross-section view of the vertical rail 60 together with a cable 100 and a cable clamp 70 attached thereto. This could be, for example, the cable clamp 70 of FIG. 13 or of FIG. 3. If clamp 70 were to be removed from the rail 60, it would not be readily lost or misplaced because of its grip on cable 100. The relative positioning of clamp 70 and wall 130 is defined by the clamp 70 having been snapped onto the rail 60, which in turn is secured to the wall 130 by fasteners 50, not visible in FIG. 11.

Figure 12:
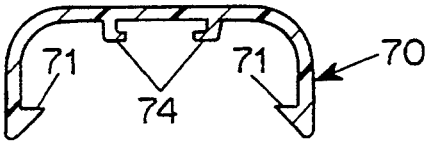
FIG. 12 is a cross-sectional view of a cable clamp of FIG. 11, or of a cable cover.

The extruded stock from which the cable clamp 70 is made is shown in more detail in FIG. 12. Ridges 71 are shaped to fit ridges 61 on the rail. Inner ridges 74 are located as shown, spaced 0.400 inches apart in this implementation to match the flat flexible cable 100. When the stock, extruded from rigid PVC, is cut to length (preferably one inch) for cable clamps 70, it is then fitted to the cable 100.

Thus it will be appreciated that the cable clamp 70 is a substantially U-shaped snap-on cable clamp, the U shape of the cable clamp 70 defining a concave side and a convex side, each cable clamp being of substantially constant cross section and shaped to fit over the rail 60, the cable clamp comprising first and second ridges 71 shaped to retain the ridges 61 of the first and second edges of the rail, the cable clamp 70 further comprising third and fourth ridges 74 located interiorly to the concave side of the cable clamp 70 and spaced to fit the flat cable 100.

There is another use for this extruded stock. Recall from FIG. 3 that a cover 140 was shown, which (together with the other elements that have been snapped onto the rail 60) protects the otherwise exposed conductors of the rail 60. The cover is simply the same stock shown in FIG. 12, cut to a longer length than that used for the cable clamps 70.

Ridges 51, 61, 71, and 81 are preferably beveled as shown in the figures so that snapping parts together is easy, and so that separation of the parts is unlikely to happen inadvertently.

Figure 13:
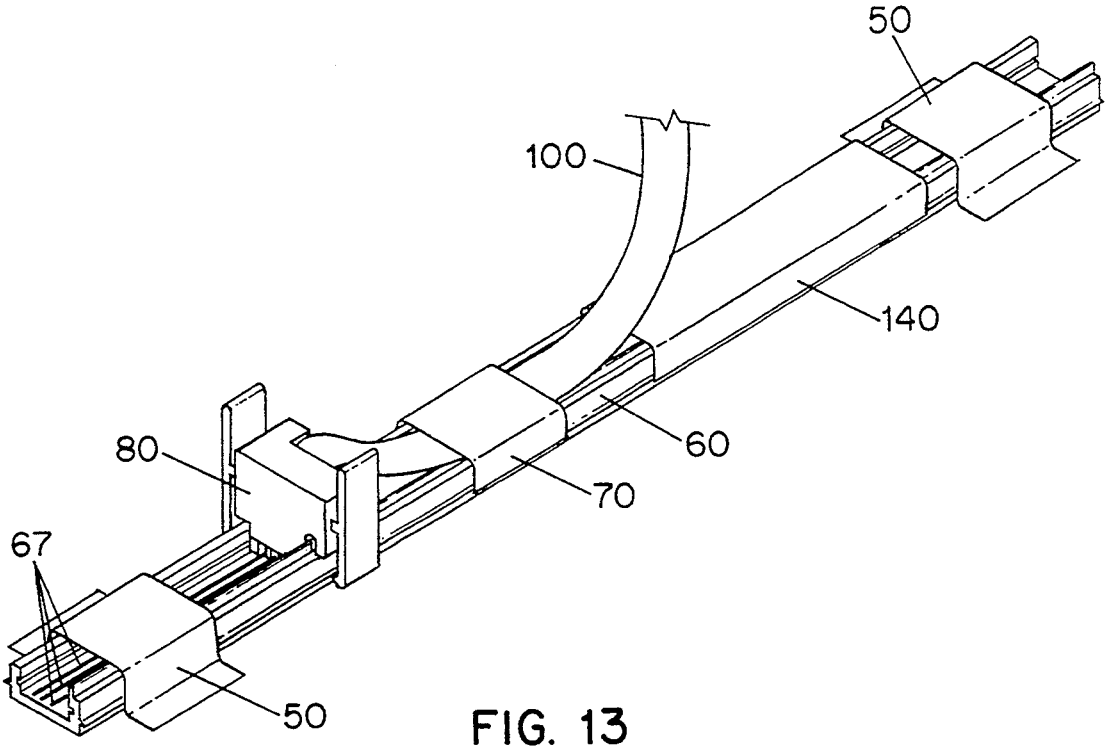
FIG. 13 is a perspective view of the vertical rail system according to the invention.

FIG. 13 is a perspective view of the vertical rail system according to the invention. Rail 60 is visible, as are conductors 67. Two fasteners 50 may be seen, and snap-on connector 80. Flat cable 100 is retained by cable clamp 70.

Figure 14:
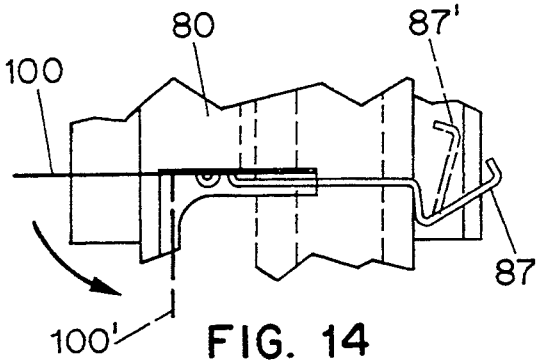
FIG. 14 shows the connector 80 in side cutaway view.

FIG. 14 shows the connector 80 in side cutaway view. Contact 87 is shown in its rest (unstressed) position prior to the connector 80 being snapped onto the rail 60, and at 87' the contact is shown when deformed after the connector 80 has been snapped onto the rail 60. Cable 100 is shown during assembly and, at 100', it is shown after being folded to 90 degrees.

Figure 15:
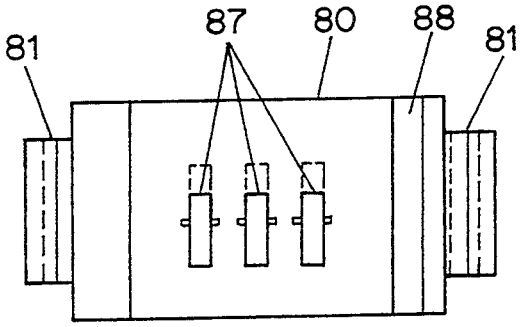
FIG. 15 shows the bottom view of the connector 80.

FIG. 15 shows a bottom view of the connector 80. Contacts 87 are shown, on center lines selected to match the center lines of the conductors 67 of the rail 60. Keying recess 88 and gripping ridges 81 are also visible in FIG. 15.

Figure 16:
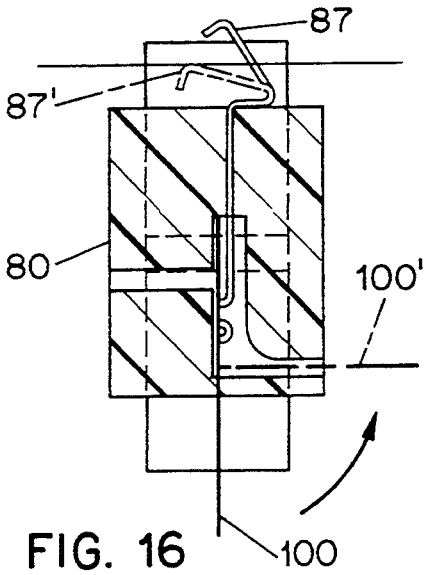
FIG. 16 is a side sectional view of the connector 80.

FIG. 16 is a side sectional view of the connector 80, corresponding in some respects with the sectional view of FIG. 9. Contact 87 is shown in its rest (unstressed) position prior to the connector 80 being snapped onto the rail 60, and at 87' the contact is shown when deformed after the connector 80 has been snapped onto the rail 60. Cable 100 is shown during assembly and, at 100' it is shown after being folded to 90 degrees. Insert 95 is omitted for clarity in FIG. 16.

Figure 17:
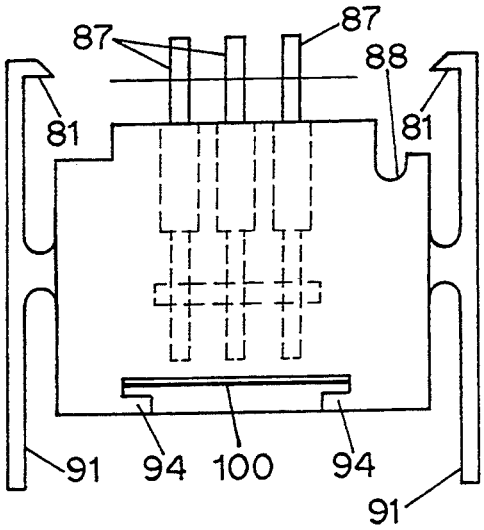
FIG. 17 is a rear view of the connector 80.

FIG. 17 is a rear view of the connector 80, corresponding in some respects with the rear view of FIG. 10. In FIG. 17 the features 94 may be more clearly seen, as may their role in confining cable 100 to its folded position, extending out of the page in FIG. 17.

The hardware of the system according to the invention having been described, it will be illustrative to describe the steps performed in installing the electronic price display system to a store, and the steps performed later in moving a shelf. Those skilled in the art will appreciate that the steps described here are faster and easier than the steps of corresponding function that would have to be performed with prior art hardware.

To install the system, whether in a new store or an existing store, the following steps are performed as may be appreciated from FIG. 2:

- a shelf rail 122 is mounted at the front of each shelf 121 in the store at which it is desired that electronic price display labels 123 are to be placed;
- vertical rails 60 are threaded or snaked into place at the rear of the shelves 121;
- fasteners 50 are snapped into place and adhesively bonded to the wall 130 of the gondola;
- for each shelf rail 122, its flat cable 100 is routed to the corresponding vertical rail 60, its protective strip is removed to expose its adhesive, the strip is pressed into place on the bottom of the shelf, and its snap-on connector 80 is snapped to the vertical rail 60;
- a cable clamp 70 previously fitted to the cable 100 is snapped into place on the rail 60, thereby dressing the cable 100 out of harm's way, with the excess if any tucked away under covers 140 or fasteners 50;
- for each shelf rail 122, at least one electronic price display label 123 is fitted thereto;
- for each electronic price display label 123, at least one message is sent by electrical means from the host 129 and conveyed by the vertical rail 60 to the electronic price display label 123.

The latter step is done, for example, according to the protocols set forth in the previously mentioned copending applications relating to label protocols. The purpose is to test the installation to be sure the host is in full communication with each label.

The installation method provides numerous advantages over those of prior art store price display systems. If the installation is done in a functioning store, the method according to the invention only requires removing stock from shelves in spaces 4 to 6 inches wide, a width that suffices to permit an installer to dress the flat cable into place and to snap the connector into place. This is because the dressing and snapping can be done one-handed. In prior art systems, typically the manipulations connecting the shelf cable to the vertical cable require two hands. The 4-to-6 inch opening also suffices for the manipulating and snaking of the vertical bus into place.

It will be further appreciated that the installation steps may be performed "blind", that is, one need not be able to see the connector snap-on location to be able to perform the associated steps. Instead, one can perform the steps while looking the other way—the flat cable exiting the connector in a particular direction naturally guides the connector into proper polarity (enhancing the protection provided by the polarization ridge 68), and the snapping in of the connector likewise can be done by feel. It will be appreciated that this also means the ambient lighting need not be perfect.

In contrast, in many prior-art systems the manipulations require two hands and require that the installer be able to see clearly the entire area under the shelf; work area lighting is often needed.

The precise sequence of removing the protective strip from the flat cable, snapping the cable clamp into place, and snapping the connector into place, is partly one of installer preference. One sequence thought to be particularly workable is to snap the cable clamp into place, then expose the cable adhesive area, then dress the cable into place on the bottom of the shelf, and then snap the connector into place.

To move a shelf 121, the steps performed are as follows:

the cable clamp 70 corresponding to the shelf 121 to be moved is removed from the rail 60;

the snap-on connector 80 corresponding to the shelf 121 to be moved is unsnapped from the vertical rail 60;

the shelf 121 is removed from the gondola 120;

the shelf 121 is moved to a new position at the gondola 120;

the shelf 121 is remounted to the gondola 120;

the snap-on connector 80 is snapped onto the vertical rail 60;

the cable clamp 70 is replaced so as to dress the cable 100 neatly; and for at least one electronic price display label 123 carried on the shelf rail 122 of the shelf 121, a message is sent from the host 129 and conveyed via the vertical rail 60 to the electronic price display label 123 to test it.

It will be appreciated that the moving procedure offers many benefits over prior art arrangements. All the advantages described above for the installation process apply here as well—the work can be done "blind", very little merchandise would have to be removed from the shelves adjacent to the shelf being moved, and the steps can be done one-handed. (The shelf being moved must, of course, be emptied first.) For shelf types where the shelf can be tipped upwards, it may be possible to do the connector steps (such as removing the connector) without having to remove any stock from the shelf below due to the shelf being tipped upwards. As with installation, the 90 degree exit path of the flat cable from the connector is such that the cable naturally prompts the technician to orient the connector correctly when inserting it to the vertical rail.

The skilled in the art will have no difficulty devising variations and changes to the embodiments given herein which in no way deviate from the invention, as defined by the following claims.

We claim:

1. A wiring system comprising:

a gondola;

a horizontal bus disposed along the length of the gondola, said bus having a plurality of wires;

a plurality of vertical rails, each vertical rail of an insulating material, each vertical rail being of substantially constant cross section along its extent, each vertical rail having a front face and a back, each vertical rail having first and second edges along its extent and a ridge along each edge, each vertical rail having a channel in the front face and a plurality of exposed conductors within the channel corresponding in number with the wires of the horizontal bus, the first and second edges further comprising first keying means rendering the first and second edges nonsymmetrical with respect to reflection in the plane lying therebetween;

connection means connecting the conductors of each vertical rail with corresponding wires of the horizontal bus; and a multiplicity of snap-on connectors with a plurality of the snap-on connectors mated to each vertical rail, each connector having first and second members engaged with the ridges of the first and second edges of its vertical rail, each connector further comprising springy contacts corresponding in number with the plurality of exposed conductors and disposed in tensioned mechanical contact therewith, each connector having a cable with wires corresponding in number with the springy contacts and electrically bonded therewith, each connector shaped between its first and second members so as to define second keying means mating with the first keying means.

2. The system of claim 1 wherein the cable is flat, the system further comprising;

at least one substantially U-shaped snap-on cable clamp, the U shape of the cable clamp defining a concave side and a convex side, each of the at least one cable clamps being of substantially constant cross section and shaped to fit over one of the vertical rails, the cable clamp comprising first and second ridges shaped to retain the ridges of the first and second edges of the one of the vertical rails, the cable clamp further comprising third and fourth ridges located interiorly to the concave side of the cable clamp and spaced to fit the flat cable;

further characterized in that the at least one cable clamp is fitted to the one of the vertical rails with its first and second edges in retentioned engagement with the edges of the vertical rail, said clamp being disposed with the flat cable of one of the snap-on connectors between its third and fourth ridges, whereby the flat cable is between the clamp and the vertical rail for the extent of the clamp.

3. The system of claim 1 wherein the number of wires in the horizontal bus is three.

4. The system of claim 1 wherein the insulating material is rigid polyvinyl chloride and the exposed conductors are tin plated, the vertical rail further comprising a mylar backing carrying the exposed conductors.

5. The system of claim 4 wherein the mylar backing is secured to the insulating material by adhesive.

6. The system of claim 1 wherein the exposed conductors are tin plated, the vertical rail further comprising a mylar backing carrying the exposed conductors.

7. The system of claim 6 wherein the mylar backing is secured to the insulating material by adhesive.

8. The system of claim 1 further comprising at least one fastener, the fastener being of substantially constant cross section along its length and having a front and a back, the back of the fastener having a concavity shaped to accommodate the vertical rail, the fastener further comprising first and second tabs disposed opposite each other with the concavity therebetween.

9. The system of claim 8 wherein the tabs of the at least one fastener have adhesive backings, the adhesive backings disposed substantially coplanar for adhesive engagement with a planar surface.

10. The system of claim 8 wherein the fastener is rigid polyvinyl chloride.

11. The system of claim 1 further comprising at least one substantially U-shaped snap-on cover, the U shape of the cover defining a concave side and a convex side, each of the at least one covers being of substantially constant cross section and shaped to fit over the vertical rail, the cover comprising first and second ridges shaped to retain the ridges of the first and second edges of the vertical rail.

12. The system of claim 11 wherein the cover is rigid polyvinyl chloride.

13. The system of claim 1 further comprising a multiplicity of shelves corresponding in number to the snap-on connectors and secured to the gondola, each shelf having a shelf rail at the front thereof shaped to receive electronic display units, each shelf rail having conductors corresponding in number to the wires of the cable of the corresponding snap-on connector and electrically bonded therewith.

14. The system of claim 13 further comprising myriad electronic price labels, a plurality of which are disposed on at least two of the multiplicity of shelf rails; and a gondola controller electrically connected with the horizontal bus; whereby the price labels disposed on the shelf rails are in electrical communication with the gondola controller.

15. A wiring system comprising:

a vertical rail of an insulating material, said rail being of substantially constant cross section along its extent, said rail having a front face and a back said rail having first and second edges along its extent and a ridge along each edge, said rail having a channel in the front face and a plurality of exposed conductors within the channel, the first and second edges further comprising first keying means rendering the first and second edges nonsymmetrical with respect to reflection in the plane lying therebetween; and a plurality of snap-on connectors mated to the rail, each connector having first and second members engaged with the ridges of the first and second edges, each connector further comprising springy contacts corresponding in number with the plurality of exposed conductors and disposed in tensioned mechanical contact therewith, each connector having a cable with wires corresponding in number with the springy contacts and electrically bonded therewith, each connector shaped between its first and second members so as to define second keying means mating with the first keying means.

16. The wiring system of claim 15 wherein the cable is a flat cable, the system further comprising:

at least one substantially U-shaped snap-on cable clamp, the U shape of the cable clamp defining a concave side and a convex side, each of the at least one cable clamps being of substantially constant cross section and shaped to fit over the rail, the cable clamp comprising first and second ridges shaped to retain the ridges of the first and second edges of the rail, the cable clamp further comprising third and fourth ridges located interiorly to the concave side of the cable clamp and spaced to fit the flat cable;

further characterized in that the at least one cable clamp is fitted to the rail with its first and second edges in retentioned engagement with the edges of the rail, said clamp being disposed with the flat cable of one of the snap-on connectors between its third and fourth ridges, whereby the flat cable is between the clamp and the rail for the extent of the clamp.

17. The system of claim 15 wherein the plurality of exposed conductors comprises parallel conductors of a flat cable disposed within the channel.

18. The system of claim 17 wherein the number of exposed conductors is three.

19. The system of claim 17 wherein the insulating material is rigid polyvinyl chloride and the exposed conductors are tin plated, the rail further comprising a mylar backing carrying the exposed conductors.

20. The system of claim 19 wherein the mylar backing is secured to the insulating material by adhesive.

21. The system of claim 15 wherein the exposed conductors are tin plated, the rail further comprising a mylar backing carrying the exposed conductors.

22. The system of claim 21 wherein the mylar backing is secured to the insulating material by adhesive.

23. The system of claim 15 further comprising at least one fastener, the fastener being of substantially constant cross section along its length and having a front and a back, the back of the fastener having a concavity shaped to accommodate the rail, the fastener further comprising first and second tabs disposed opposite each other with the concavity therebetween.

24. The system of claim 23 wherein the tabs of the at least one fastener have adhesive backings, the adhesive backings disposed substantially coplanar for adhesive engagement with a planar surface.

25. The system of claim 23 wherein the fastener is rigid polyvinyl chloride.

26. The system of claim 15 further comprising at least one substantially U-shaped snap-on cover, the U shape of the cover defining a concave side and a convex side, each of the at least one covers being of substantially constant cross section and shaped to fit over the rail, the cover comprising first and second ridges shaped to retain the ridges of the first and second edges of the rail.

27. The system of claim 26 wherein the cover is rigid polyvinyl chloride.

* * * * *